US005433150A

United States Patent [19]

Long, Jr. et al.

[11] Patent Number: 5,433,150

[45] Date of Patent: Jul. 18, 1995

[54] TRAVELING CRANE

[75] Inventors: Herbert D. Long, Jr.; Robert H. Reuss, both of West Allis, Wis.

[73] Assignee: Harnischfeger Corporation, Brookfield, Wis.

[21] Appl. No.: 187,666

[22] Filed: Jan. 26, 1994

[51] Int. Cl.[6] ..... B66C 5/00

[52] U.S. Cl. ..... 105/163.2

[58] Field of Search ..... 105/163.1, 163.2; 212/205, 210, 218, 219

[56] References Cited

U.S. PATENT DOCUMENTS

| | | | |
|---|---|---|---|
| 1,181,324 | 5/1916 | Lent | 105/163.2 |
| 2,708,715 | 5/1955 | Meyers | 105/163.2 |
| 3,204,577 | 9/1965 | Smith | 105/163.2 |
| 3,703,016 | 11/1972 | Schramm et al. | 105/163.2 |
| 4,505,207 | 3/1985 | Bagarie et al. | 105/163.2 |
| 4,890,750 | 1/1990 | Stern | 105/163.2 |

FOREIGN PATENT DOCUMENTS

| | | | |
|---|---|---|---|
| 0490185 | 6/1992 | European Pat. Off. | 105/163.2 |
| 1581679 | 7/1990 | U.S.S.R. | 105/163.2 |

*Primary Examiner*—Mark T. Le
*Attorney, Agent, or Firm*—Richard C. Ruppin

[57] ABSTRACT

A gantry crane travelable along a pair of rails and having an overhead girder transverse to the direction of travel, first and second legs connected to the girder, a load carrying trolley movable along the girder to a first position adjacent the first leg and to a second position adjacent the second leg, first and second spaced apart motor drives mounted on one of the legs in engagement with one of the rails for moving the crane, and third and fourth spaced apart motor drives mounted on the other leg in engagement with the other rail for moving the crane. When the trolley is at the first position, the first and second drives are highly loaded and the third and fourth drives are lightly loaded. Thereby, the lightly loaded drives attempt to drive the second leg such that it leads the first leg and skews the crane. When the trolley is at the second position, the third and fourth drives are highly loaded and the first and second motor drives are lightly loaded. Consequently, the lightly loaded drives attempt to drive the first leg such that it leads the second leg and skews the crane. A power source is connected to the first and third drives and a power source is connected to the second and fourth drives. The power sources are responsive to the presence of the trolley at either its first or second position to provide a large portion of their electrical power to the highly loaded motor drives to prevent skew.

7 Claims, 3 Drawing Sheets

TRAVELING CRANE

FIELD OF THE INVENTION

This invention relates to a traveling crane having a drive which moves the crane along spaced apart rails. More particularly, the invention relates to a drive for the legs of a gantry crane which prevents skewing of the crane on the rails along which it travels.

BACKGROUND OF THE INVENTION

Portal type gantry cranes having long overhead girder frame spans are subject to considerable movement along the girder length and in the gantry leg due to picking up and releasing a load, moving the load along the girder, and moving the girder along the rails while carrying a load. This movement causes stressing of frame members which is very high at joints of braces in truss type gantry girders. This is especially true where the girders of portal cranes are cantilevered in the direction of the length of the girders beyond the legs. Where the trolley of the crane is moved to a position adjacent the legs including a position on the girder end cantilevered from the legs, the load on the adjacent leg is particularly high and the high load at the girder end causes cracking and failure of the girder brace connections.

When the loaded trolley is positioned adjacent a leg on either end of the girder frame, the concentration of the load on the leg highly loads the drive means which moves the leg along one of the rails on which the crane operates. The high loading of the leg may result in the drive means accelerating the highly loaded leg at a slower rate than the lightly loaded second leg of the crane is accelerated by its drive means. This results in a skew of the crane on the rails which significantly increases the stressing of the girder brace and leg joints. The additional stressing correspondingly greatly increases the brace joint cracking and failure.

There are various types of skew sensing systems for minimizing or preventing skew of a crane. However, these systems tend to be complex and expensive. The instant invention provides a relatively simple and inexpensive solution to skew problems.

SUMMARY OF THE INVENTION

It is a general object of this invention to provide a traveling crane in which, during acceleration, the acceleration rate of a highly loaded leg and its drive means is maintained substantially the same as the acceleration rate of a lightly loaded leg and its drive means to thereby prevent skew of the crane. It is a further object of the invention to provide a traveling crane having a drive means responsive to the position of a trolley load adjacent one leg to maintain the acceleration of that leg substantially the same as the acceleration of a second leg of the crane. It is another object of the invention to provide a gantry type traveling crane having an overturning moment load during acceleration which decreases the acceleration rate with a drive means which carries the overturning moment load and maintains the acceleration rate.

The invention is accomplished by providing a crane which is travelable along a pair of spaced apart rails with an overhead girder having a length transverse to the direction of travel of the crane on the rails and first and second legs connected to the girder and respectively extending downward toward one of the parallel rails. The crane includes a trolley which is movable along the length of the girder for carrying a load. A plurality of motor drives are provided for moving the crane along the rails. The first and second ones of the plurality of motor drives are mounted on the first leg in engagement with one of the rails and are spaced apart in the direction of travel of the crane. Third and fourth ones of the plurality of motor drives are mounted on the second leg in engagement with the other rail and are also spaced apart in the direction of travel of the crane. The trolley is movable along the girder to a first position adjacent the first leg and also to a second position adjacent the second leg.

When the trolley is at the first position, the first and second motor drives have a highly loaded condition and the third and fourth motor drives have a lightly loaded condition. As a result, the lightly loaded third and fourth motor drives attempt to drive the second leg such that it leads the first leg and skews the crane. When the trolley is at the second position, the third and fourth motor drives have a highly loaded condition and the first and second motor drives have a lightly loaded condition. Consequently, the first and second motor drives attempt to drive the first leg such that it leads the second leg and skews the crane. A first power source is electrically connected to the first and third motor drives for providing electrical power to these drives and a second power source is electrically connected to the second and fourth motor drives for providing electrical power to the latter drives. Thus, when the trolley is at the first position the first and second power sources are responsive to the position of the trolley to provide a large portion of their electrical power to the highly loaded first and second motor drives on the first leg to prevent skew due to the leading second leg. When the trolley is at the second position, the first and second power sources are responsive to the position of the trolley to provide a large portion of their electrical power to the highly loaded third and fourth motor drives on the second leg to prevent skew due to the leading first leg.

When the crane is accelerating in either of the opposite directions in which it is movable on the parallel rails, it has an overturning moment in the direction of movement. The overturning moment causes the motor drives located on the first and second legs in the direction of the acceleration and overturning moment to be highly loaded. Such high loading decreases the acceleration rate of the crane in such direction. However, each of the power sources is connected to the motor drive at the end of a leg in one direction of acceleration and overturning moment of the crane and to another motor drive in the other direction of acceleration and overturning moment of the crane. Thus, in either direction of acceleration of the crane, the motor drives positioned on the legs in the direction of acceleration of the crane are responsive to power from both the first and second power sources to accelerate the crane despite the load due to the overturning moment.

BRIEF DESCRIPTION OF THE DRAWINGS

Further advantages of the invention will appear when taken in conjunction with the accompanying drawings, in which.

DETAILED DESCRIPTION OF THE INVENTION

Figure 1:
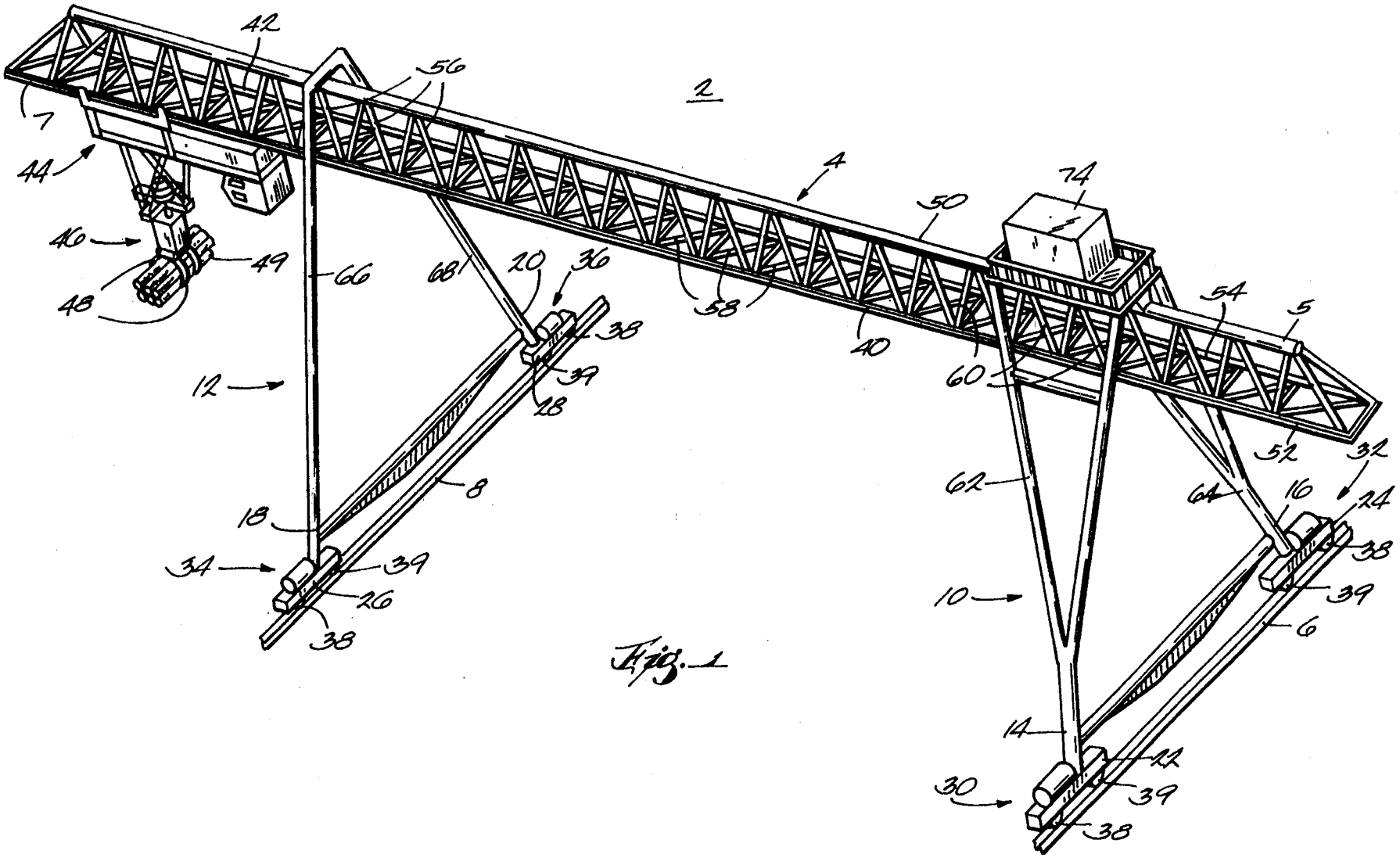
FIG. 1 is a perspective view of a traveling portal-type gantry crane according to the invention.
Figure 2:
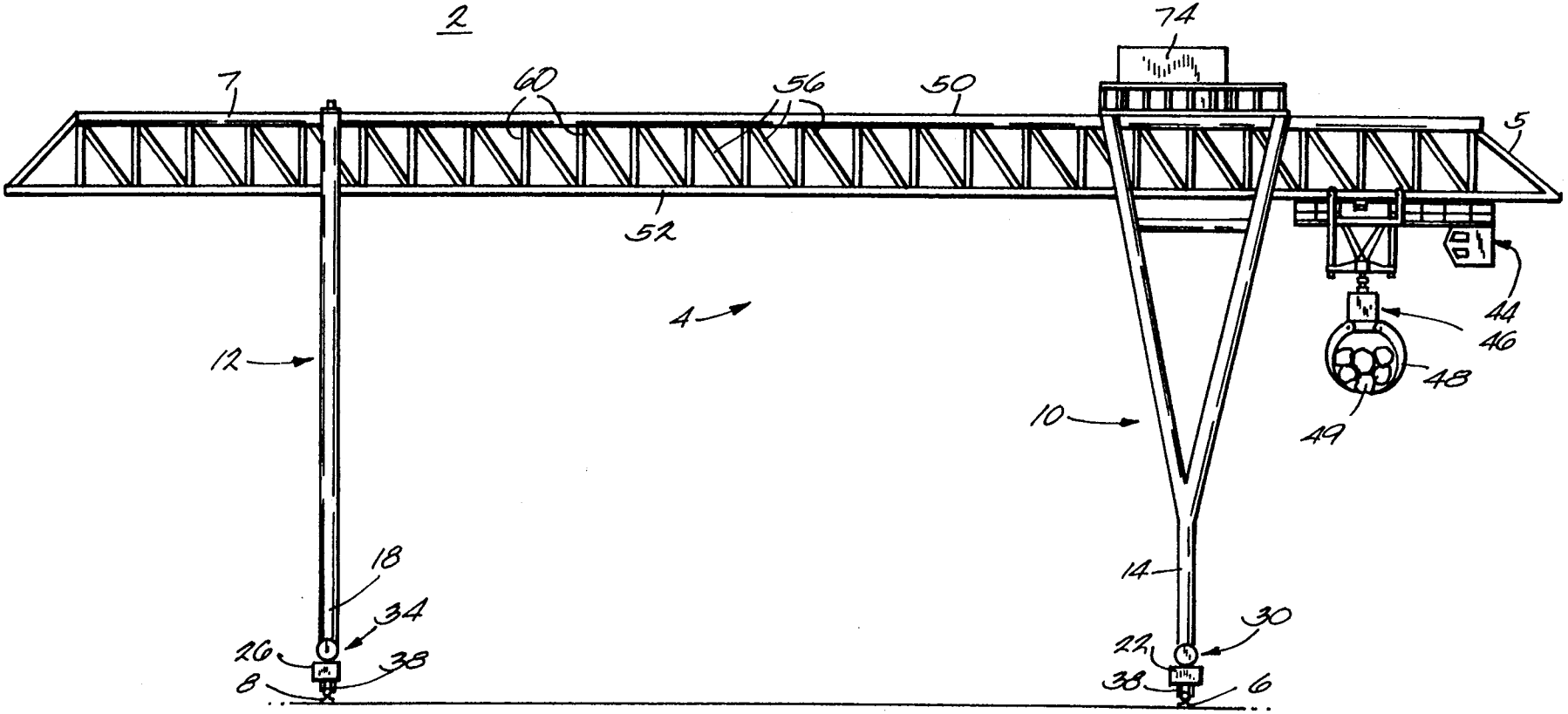
FIG. 2 is a front elevation view of the crane illustrated in FIG. 1.
Figure 3:
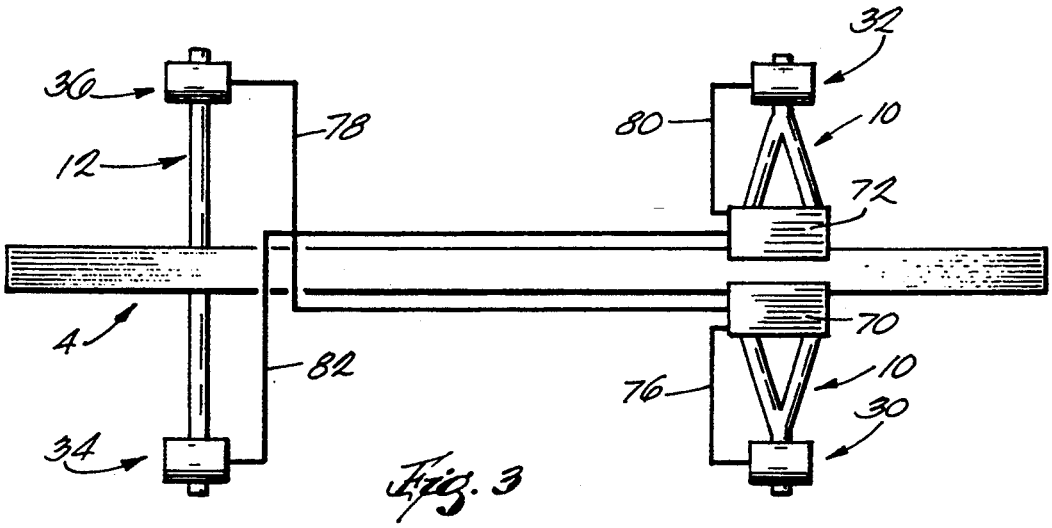
FIG. 3 is a schematic view of the crane shown in FIGS. 1 and 2 illustrating the connection of power source means to the motor drives of the crane.

Referring generally to FIGS. 1-3 of the drawing, a portal type gantry crane is illustrated as having a frame 2 including an elongated girder 4 having a length extending transversely of and overlying two generally parallel rails 6 and 8. The frame 2 also includes two spaced apart legs 10 and 12 affixed to the girder 4 adjacent the ends 5 and 7 of the latter and respectively extending downward from the frame toward the rails 6 and 8. The rails 6 an 8 are laid in a material storage area such as a log yard in which logs are stored prior to their use for paper or other wood products. The legs 10 and 12 respectively have lower base ends 14, 16, 18, and 20. The ends 14, 16 are spaced apart in the opposite directions of travel of the crane and the ends 18, 20 are also spaced apart in the opposite directions of travel of the crane. The leg 10 includes a pair of trucks 22 and 24 respectively affixed to the ends 14 and 16 and the leg 12 includes a pair of trucks 26 and 28 respectively affixed to the ends 18 and 20. Motor drives 30, 32, 34 and 36 are respectively mounted on the trucks 22, 24, 26 and 28. Each of the motor drives 30, 32, 34 and 36 includes a drive wheel 38 rotated by the drive means and engaging and riding on one of the rails 6 or 8, thus permitting the crane to travel along the rails 6 and 8 through the material storage area. In addition, at least one non-driven idler wheel 39 is mounted on each truck in engagement with rail 6 or 8.

A pair of parallel tracks 40 and 42 are affixed to the girder 4 and support a trolley 44 for travel along the length of the girder 4. A hoist 46 is mounted on the trolley 44 and includes a load carrying device such as a grapple hook 48 for raising and lowering a load 49 of material, such as the logs which are to be stored in or removed from the storage area, and holding the load 49 as the trolley 44 moves along the tracks 40 and 42, and the crane moves along the rails 6 and 8.

The girder 4 is generally of a truss construction having a top chord 50 and two bottom chords 52 and 54 comprising wide flange I-beams, all extending substantially the length of the girder 4. Upper diagonal braces 56 are connected between the top chord 50 and the bottom chords 52 and 54. Bottom diagonal braces 58 and perpendicular braces 60 connect the bottom chords 52 and 54. As may be seen in FIG. 1, the chords and braces are positioned such that the girder 4 has a triangular cross-section.

The leg 10 is positioned toward one end 5 of the length of the girder 4 and includes a leg section 62 comprising a tubular member terminating in the base end 14 and a leg section 64 comprising a tubular member terminating in the base end 16. The leg 12 is positioned toward the other end 7 of the length of the girder 4 and includes a leg section 66 comprising a tubular member terminating in the base end 18 and a leg section 68 terminating in the base end 20. In providing stable support for the frame 2, the pair of tubular members 62, 64 of the leg 10 and the pair of tubular members 66, 68 of the leg 12 extend downward and away from each other, and away from the girder 4.

The motor drives 30 and 32 are respectively mounted on trucks 22 and 24 at opposite ends 14 and 16 of leg 10 and the motor drives 34 and 36 are respectively mounted on trucks 26 and 28 at opposite ends 18 and 20 of leg 12, as previously described. With reference to FIGS. 1-3, power sources 70 and 72 are located in the control house 74 positioned on top of the overhead girder 4 and are preferably of the adjustable frequency inverter type. The power source 70 is electrically connected by a cable 76 to the motor drive 30 and by a cable 78 to the motor drive 36 to provide electrical power to these two connected motor drives. The electrical power source 72 is electrically connected by a cable 80 to the motor drive 32 and by a cable 82 to the motor drive 34.

When the trolley 44 is at positions adjacent either of the legs 10 and 12 such as shown, for example, in FIGS. 1 and 2, the leg to which the trolley is most adjacent will carry a large portion of the load of the trolley and the other leg will be very lightly loaded. The positions adjacent the legs may be between the legs 10 and 12, between the tubular members of the legs or cantilevered outward of the legs. The load on the single leg adjacent to the trolley is particularly high when the trolley is positioned outward of the adjacent leg, that is, in a cantilevered position on the girder 4 relative to the adjacent legs 10 or 12. This very high load is due to the bending moment effect of the cantilevered portion of the girder 4 which loads the adjacent leg. Swinging movement of the trolley load and swaying movement of the entire portal crane 2 also increases the load on the adjacent leg. The high load on the leg adjacent to the trolley position is carried by the motor drives 30, 32 or 34, 36 when the motor drives accelerate the drive wheels 38 and thereby the crane 2 and move the crane on the rails 6 and 8. However, because of the high load on the leg adjacent the trolley and the light load on the leg farthest from the trolley, the lightly loaded leg will accelerate faster and thereby lead the heavily loaded leg. This will result in skew of the crane and such skew has an extreme exacerbating effect on the loading of the heavily loaded leg and adjacent girder end and thereby stressing of the brace joints with the girder 4 as well as the legs and their connecting joints with the girder 4. Relatively rapid cracking of the connections of the girder brace 56, 58 and 60 and possibly leg to girder connections and failure of the connections follows. As a result of the skew, the heavily loaded motor drives on the lagging leg will demand more power than their connected power supplies can provide. This will cause power supplies such as adjustable frequency inverter types to rapidly deteriorate and burn out. Alternatively, the power supplies may have overload protection devices which limit the power they can supply when a high overload is sensed. In the latter case, the power provided by the power supply will be inadequate to permit the motor drives on the lagging leg to accelerate sufficiently to prevent the skew.

However, with the power source 70 connected to the motor drive 30 and motor drive 36 and the power source 72 connected to the motor drive 32 and the motor drive 34, a large portion of the power from both of the power sources 70 and 72 is available to either one of the highly loaded legs, when the trolley is positioned adjacent that leg, in response to the load of the trolley transmitted through the girder 4 and the motor drive for the highly loaded leg. The level of power available from each power source 70 or 72 to the highly loaded motor drives on the leg most adjacent the trolley, is the maximum power that is available from the power source with the exception of power needed from the power source for maintaining the electromagnetic field and supplying losses in the connected motor drive on the lightly loaded leg. This providing of a large portion of the power from both of the power sources to substantial leg only the motor drives of the highly loaded leg will permit those motor drives to accelerate the end of the crane in the lagging position due to the high load of the trolley on that end and prevent skewing of the crane on the rails 6 and 8 from occurring.

A further drive problem of gantry type portal cranes, particularly taller portal cranes, relates to an overturning moment of the crane during rapid acceleration. It is desirable for productivity purposes to accelerate or move the crane as rapidly as possible while carrying a load from one location to another or moving unloaded to retrieve a load. However, rapid acceleration produces a moment essentially about the base of the crane in the direction of its acceleration having an overturning tendency which increases the load on the legs and the motor drives on the legs that are positioned in the direction of the acceleration movement. The high loading of the legs and their motor drives in the acceleration direction will often result in overloading of the motor drives in the acceleration direction so that, in fact, their power sources will be unable to supply the power necessary to provide the rapid acceleration. In the embodiment shown in FIG. 3 of the invention, each of the power sources 70 and 72 are connected to motor drives on opposite ends of legs and thereby on leg ends that are in both of the two possible directions of acceleration of the crane on the rails 6 and 8. Thus, substantially the entire power of both power sources 70 and 72 is available to the motor drives in the direction of acceleration of the crane to thereby provide the necessary power to handle the increased load due to the overturning moment in either acceleration direction.

Figure 4:
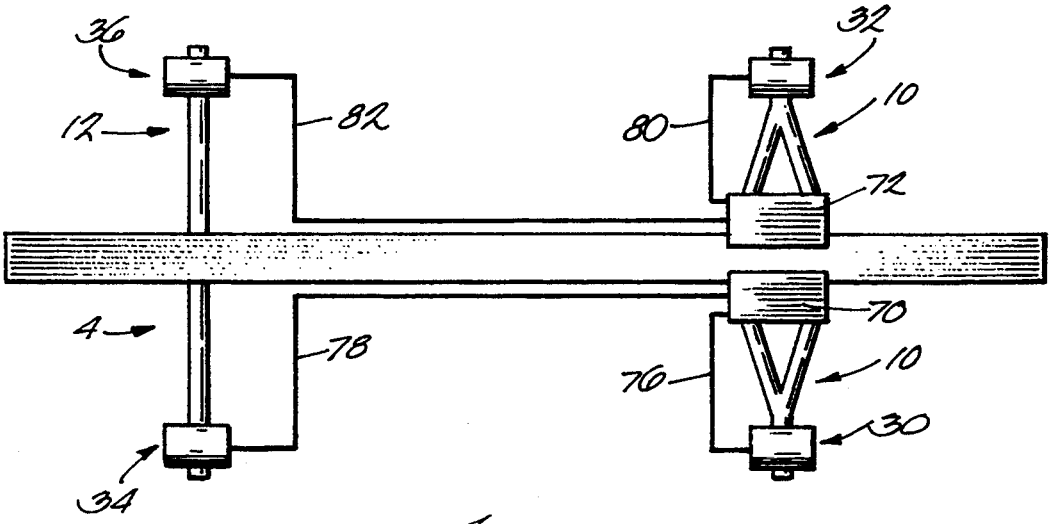
FIG. 4 is a schematic view of an alternate embodiment of the invention illustrating a connection of the power source means to the motor drives of the legs of the crane.

An alternate embodiment of the invention is shown in FIG. 4 in which the cables 80 and 82 of the power source 72 are respectively connected to the motor drive 30 on the leg 10 and the motor drive 36 on the leg 12. The cables 76 and 78 of the power source 70 are respectively connected to the motor drive 30 on the leg 10 and the motor drive 34 on the leg 12. Thus both power sources 70 and 72 have substantially their entire power level available to the motor drives at opposite ends of the girder to provide a large amount of power to the highly loaded leg when the trolley is positioned adjacent such leg. This level of power supply will prevent skew of the crane occurring during acceleration. However, this embodiment of the invention will not provide the acceleration desired when there is a high loading problem of the legs and the motor drives due to overturning moment loading.

It will be understood that the foregoing description of the present invention is for purposes of illustration only, and that the invention is susceptible to a number of modifications or changes none of which entail any departure from the spirit and scope of the present invention, as defined in the hereto appended claims.

What is claimed is:

1. A crane supported on and travelable along a pair of spaced apart generally parallel rails and including an overhead girder having a length transverse to the direction of travel of the crane, first and second legs connected to the girder and respectively extending downward toward one of the parallel rails, and a trolley movable along the length of the girder for carrying a load, comprising:

first, second, third and fourth motor drive means for moving the crane along the rails, the first and second drive means being mounted on the first leg in engagement with one of the rails and spaced apart in the direction of travel of the crane, the third and fourth drive means being mounted on the second leg in engagement with the other of the rails and spaced apart in the direction of travel of the crane;

the trolley being movable to first and second positions respectively adjacent the first and second legs, the first and second motor drive means having a highly loaded condition and the third and fourth drive means having a lightly loaded condition when the trolley is at the first position whereby the lightly loaded third and fourth drive means tend to drive the second leg such that it leads the first leg and skews the crane, the third and fourth motor drive means having a highly loaded condition and the first and second motor drive means having a lightly loaded condition when the trolley is at the second position whereby the lightly loaded first and second drive means tend to drive the first leg such that it leads the second leg and skews the crane;

first power source means electrically connected to the first and third motor drive means for providing electrical power to the first and third motor drive means, and second power source means electrically connected to the second and fourth motor drive means for providing electrical power to the second and fourth motor drive means, the first and second power source means each having a large portion of their electrical power available to either motor drive means to which they are respectively connected; and the first and second power source means are responsive to the presence of the trolley at its first position to respectively provide said large electrical power portions to the highly loaded first and second motor drive means on the first leg to prevent skew due to the leading second leg, and the first and second power source means are responsive to the presence of the trolley at its second position to respectively provide said large electrical power portions to the highly loaded third and fourth motor drive means on the second leg to prevent skew due to the leading first leg.

2. The crane according to claim 1 wherein:

the crane is movable in first and second opposite directions along the rails and the first and second legs each have opposite ends respectively toward the first and second movement directions; and the first and fourth motor drive means are respectively mounted on the ends of the first and second legs toward the first direction of movement of the crane and the second and third motor drive means are respectively mounted on the ends of the first and second legs toward the second direction of movement of the crane.

3. The crane according to claim 1 wherein:

the crane is movable in first and second directions along the rails and the first and second legs each have opposite ends respectively toward the first and second movement directions;

the first and fourth motor drive means are respectively mounted on the ends of the first and second legs toward the first direction of movement of the crane and the second and third motor drive means are respectively mounted on the ends of the first and second legs toward the second direction of movement of the crane;

the crane has an overturning moment condition in the direction of movement during acceleration when moving in either of said directions;

the first and fourth motor drive means have a highly loaded condition due to the overturning moment condition when the crane is accelerating in the first direction of movement which decreases the rate of such acceleration and the second and third motor drive means have a highly loaded condition due to the overturning moment condition when the crane is accelerating in the second direction of movement which decreases the rate of such acceleration; and the first and fourth motor drive means are respectively responsive to power from the first and second power source means to increase the rate of acceleration on the crane despite the load due to the overturning moment and the second and third motor drive means are respectively responsive to power from the first and second power sources to increase the acceleration rate of the crane despite the load due to the overturning moment.

4. The crane according to claim 1 wherein the first and second power source means each comprise an adjustable frequency inverter having a maximum power supply level, substantially the maximum power supply level of each inverter being available to either one of the rotating drive means to which each inverter is connected.

5. The crane according to claim 1 wherein:

the crane and the first, second, third and fourth motor drive means have an accelerating condition; and the first and second power source means are also responsive to the accelerating condition of the first, second, third and fourth motor drive means to provide said large electrical power portions to the highly loaded first and second or third and fourth motor drive means.

6. A crane supported on and travelable along a pair of spaced apart generally parallel rails, the crane having a frame including an overhead girder having opposite ends and a length transverse to the direction of travel of the crane, first and second spaced apart legs connected to the girder and extending downward from the opposite ends of the girder, each leg having a plurality of drive wheels engaging one of the parallel rails, and a trolley movable along the length of the girder for carrying a load, comprising:

first and second motor drive means respectively mounted on the first and second legs for driving the plurality of wheels on each leg and moving the crane along the rails;

the trolley has a first position adjacent one of the ends of the girder at which the first motor drive means is highly loaded and the second motor drive means is lightly loaded whereby the lightly loaded second leg drive means tends to drive the second leg such that it leads the first leg and skews the crane, the trolley also having a second position adjacent the other of the ends of the girder at which the second motor drive means is highly loaded and the first motor drive means is lightly loaded whereby the lightly loaded first motor drive means tends to drive the first leg such that it leads the second leg and skews the crane; and first and second power source means both electrically connected to the first and second motor drive means such that, when the trolley is at the first position, a large portion of the electrical power from both the first and second power source means will be respectively provided to the highly loaded first drive means and, when the trolley is at the second position, a large portion of the electrical power from both the first and second power source means will be respectively provided to the highly loaded second drive means to prevent skew of the crane due to one of the first and second legs leading the other.

7. The crane according to claim 3 wherein the first and second power source means each comprise an adjustable frequency inverter having a maximum power supply level, substantially the maximum power supply level of each inverter being available to either one of the rotating drive means to which each inverter is connected.

* * * * *